United States Patent [19]

Andersson

[11] Patent Number: 4,720,361

[45] Date of Patent: Jan. 19, 1988

[54] IMMERSIBLE AERATOR AND/OR MIXER APPARATUS

[75] Inventor: Arvo E. Andersson, Outokumpu, Finland

[73] Assignee: Outokumpu Oy, Helsinki, Finland

[21] Appl. No.: 830,967

[22] Filed: Feb. 19, 1986

[30] Foreign Application Priority Data

Feb. 20, 1985 [FI] Finland ..... 850690

[51] Int. Cl.[4] ..... B01F 3/04

[52] U.S. Cl. ..... 261/87

[58] Field of Search ..... 261/87, 93

[56] References Cited

U.S. PATENT DOCUMENTS

| | | | |
|---|---|---|---|
| 3,053,390 | 9/1962 | Wood | 261/93 |
| 3,189,334 | 6/1965 | Bell | 261/93 |
| 3,279,768 | 10/1966 | Niewiarowicz | 261/93 |
| 3,305,215 | 2/1967 | Swiecicki et al. | 261/87 |
| 3,796,417 | 3/1974 | Kaelin | 261/93 |
| 3,891,729 | 6/1975 | Ebner | 261/87 |
| 4,078,026 | 3/1978 | Fallenius | 261/87 |
| 4,540,290 | 9/1985 | Jarvinen et al. | 261/91 |

FOREIGN PATENT DOCUMENTS

| | | | |
|---|---|---|---|
| 1158945 | 8/1961 | France | 261/87 |

*Primary Examiner*—Tim Miles

*Attorney, Agent, or Firm*—Dellett, Smith-Hill and Bedell

[57] ABSTRACT

The object of the present invention is to protect the driver unit (1) of an immersible aerator and/or mixer apparatus against the surrounding liquid. The driver unit (1) is covered with a compact protective casing (5), to the bottom part whereof the gas to be lead into the mixer (14) is conducted through the gas supply pipe (2). At the junction of the gas supply pipe (2), inside the protective casing (5), there is located a gas supply channel (6) which is open at both ends, and this gas supply channel (6) conducts the gas to flow mainly upwards, to the top part of the driver unit. At its bottom, the protective casing (5) is attached to the base disc (7), and the gas flows through the holes (10) provided in the base disc (7) into the channel formed by the gas control cone (11) and the inner cone (12), and therefrom into the liquid either via the partly hollow secondary axis (13) of the mixer or via a separate gas pipe. During an interruption in the gas supply, the inner cone (12) forms a gas lock which protects the top end of the secondary axis, and the roughly 90° angle in the gas supply pipe (2) forms a gas lock which protects the motor.

19 Claims, 2 Drawing Figures

(A - A)

IMMERSIBLE AERATOR AND/OR MIXER APPARATUS

The present invention relates to an immersible aerator and/or mixer apparatus, and particularly for protecting the driving unit of the said apparatus against the surrounding liquid.

Most prior art mixers are operated suspended from an axis which is hanged above the liquid. However, the area of the mixing or aeration basin may set certain limitations for a mixer operated suspended from an axis, particularly if the mixing or aerating operation should not be carried out on the surface of the liquid but in the vicinity of the basin bottom. The driver unit of a mixer which is located at the basin bottom can naturally be of the immersible type, but in that case it must be an expensive special arrangement.

The object of the present invention is to protect the immersible driving unit of the mixer against the surrounding liquid so that the protection is provided by means of a simple and economic arrangement. Thus the mixer driving unit located at the bottom part of the basin can be furnished with standard motors and standard gearings without any need for special arrangements.

The U.S. Pat. No. 4,540,290 describes an apparatus, the purpose whereof is to protect the driver unit of an aerator and/or mixer unit against the surrounding liquid. In this apparatus, the protection is provided by means of three nested casings. Air is conducted into the upper part of the driver unit.

According to the present invention, the gas, for instance air, which is conducted into the aerator and/or mixer apparatus, is brought into the driver unit at the lower part thereof. By means of the gas control casing, the gas is first conducted into the upper part of the driver unit in order to cool the motor, whereafter the gas is conducted further downwards and out of the driver unit, through the holes provided in the base disc located at the bottom of the driver unit, into the gas control cone and further into the hollow shaft of the mixer, in order to feed the gas either via the axis or by some other means into the sludge to be aerated or mixed. During an interruption in the gas supply, the top part of the said shaft is protected against the surrounding liquid by means of an inner cone placed inside the gas control cone. The major novel features of the invention are apparent from the patent claim 1.

The invention is explained in more detail with reference to FIGS. 1 and 2.

Figure 1:
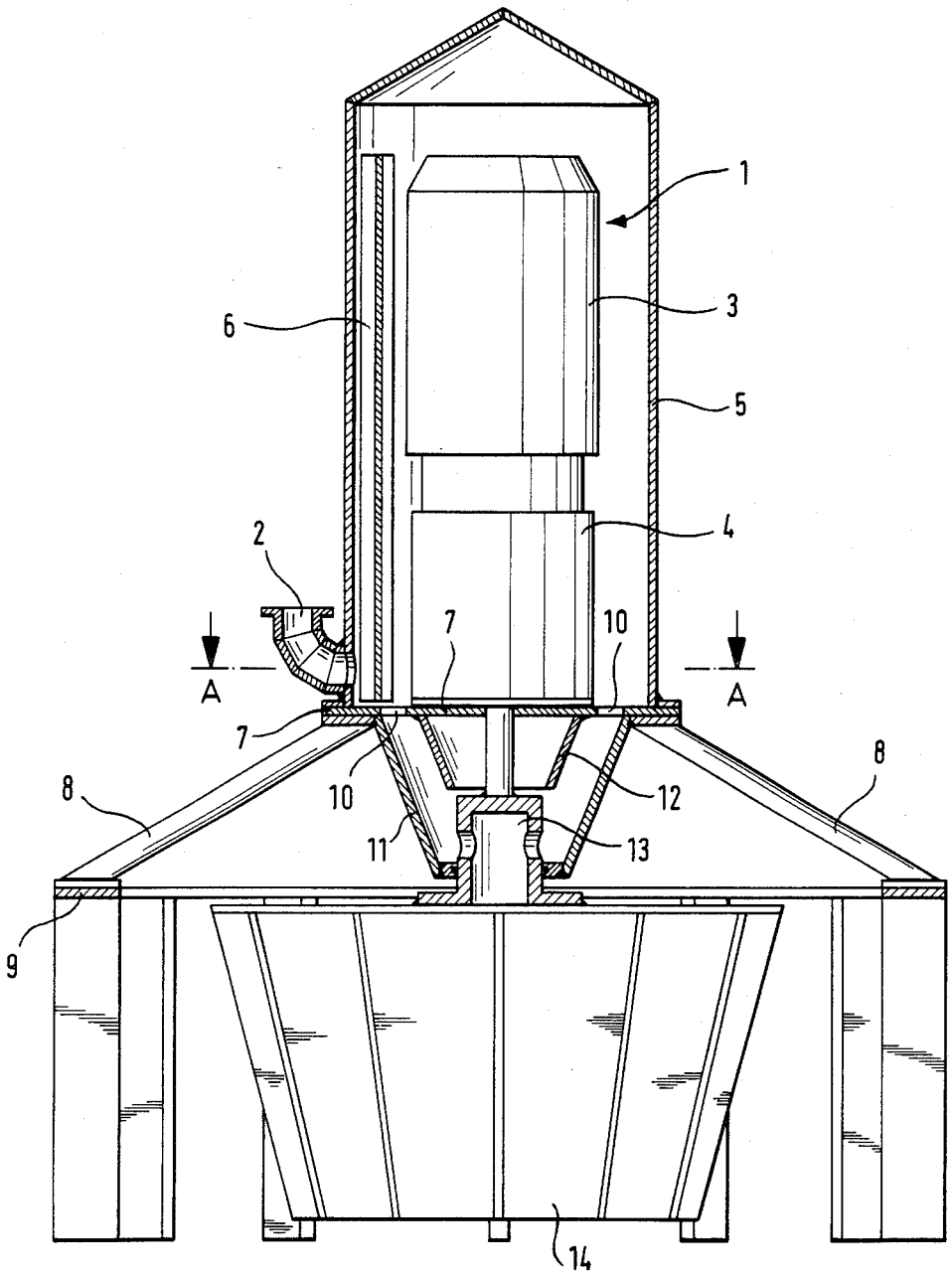
FIG. 1 is a vertical cross-section view of an apparatus of the invention.
Figure 2:
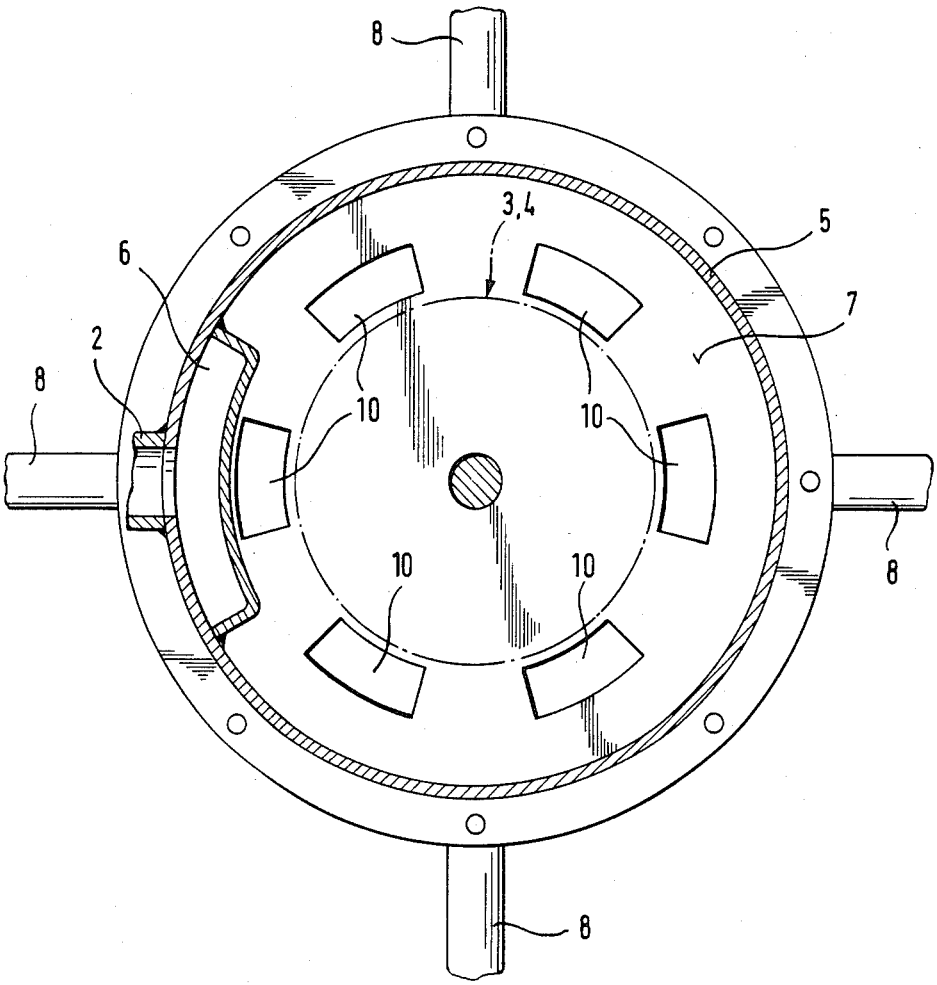
FIG. 2 is a cross-section view of the apparatus of FIG. 1, seen along the line A—A.

According to FIG. 1, the gas, such as air, is conducted into the driver unit 1 of an aerator and/or mixer unit located in a basin, and more precisely into the bottom part of the said driver unit, along the gas supply pipe 2. The driver unit 1 mainly comprises the motor 3 and the gearing assembly 4 located below the motor. The compact protective casing 5 serves as the outer cover for the driver unit. The gas is generally brought into the driver unit 1 from above by means of a pipe, tube or equivalent. The gas supply pipe 2 is so designed that the pipe forms a bend of roughly 90° immediately before the juncture to the protective casing 5, so that at the juncture the end of the gas supply pipe is essentially in horizontal position. Inside the protective casing 5, the gas fed in through the gas supply pipe first enters the gas control channel 6 which is essentially vertical and open both at the top end and the bottom end. As is seen in FIG. 2, the gas control channel 6 extends only to a short distance away from the gas supply point but does not go round the whole inside of the protective casing 5. In practice the width of the channel 6 is 3–10 times the diameter of the gas supply pipe 2. The wide side of the channel is advantageously parallel to the protective casing 5, and the end sides are connected to the protective casing 5. The gas control channel 6 guides the majority of the supplied gas into the top part of the driver unit 1, so that the gas, while flowing downwards therefrom, simultaneously cools down the motor 3. It is noteworthy that the protective casing 5 of the driver unit is completely closed at the top; the only aperture provided in the casing is the gas supply opening 2 at the bottom part of the casing. The bottom of the protective casing is attached to the base disc 7. It is advantageous to arrange the power supply to be brought in together with the gas supply.

The motor 3 is connected by means of the primary axis (not represented in detail in the dawing) to the gearing assembly 4 located below the motor. The gearing 4 is supported against the base disc 7. The supporting legs 8 of the driver unit 1, placed below the basic disc 7, which legs can be for example tubular legs, are at their bottom attached to the mixer housing 9.

The base disc 7 is provided with holes 10, through which the gas conducted inside the protective casing 5 flows into the channel located between the gas control cone 11 placed below the base disc 7 and the inner cone 12 placed inside the gas control cone 11. From this channel between the two cones, the gas is conducted into the liquid through the secondary shaft 13 which comes out of the gearing assembly 4 and is partly hollow, and by aid of the mixer 14. The inner cone 12 is roughly parallel to the gas control cone 11. The gas control cone 11 advantageously extends from the base disc 7 to the bottom part of the secondary shaft 13, and the interval between the secondary shaft 13 and the gas control cone 11 is sealed tight at this point. The inner cone 12 is placed so that it extends from the base disc 7 downwards, roughly halfway down with respect to the secondary shaft 13, and the said inner cone 12 has an open bottom. The holes 10 are located in the base disc 7, in the area thereof which is limited on its lower side by the upper edges of the gas control cone 11 and the inner cone 12, both cones being supported against the base disc 7.

The inner cone 12 serves as the gas locking cone of the mixer shaft coming out of the gearing 4, i.e. of the secondary shaft 13. During an interruption in the gas supply, the liquid surrounding the mixer and its driver unit tends to rise, along the secondary shaft, up to the channel left between the two cones and even further upwards. The liquid rising upwards compresses the gas contained in the inner cone, and because the base disc is closed above the inner cone, the gas remains in the top part of the inner cone and protects the top end of the secondary shaft.

During an interruption in the gas supply, the liquid also rises through the holes located in the base disc to inside the protective casing of the driver unit, but owing to the upwards winding design of the gas supply pipe 2, the presence of the liquid prevents the gas from flowing out through the pipe, in which case the gas remains within the driver unit. The gas control channel makes the gas to circulate within the driver unit and prevents it from flowing directly into the mixer through the holes in the base disc. In practice the top limit of the liquid surface remains within the bottom part of the protective casing, and the top part of the protective casing forms a gas lock which protects the motor.

Consequently, by employing an apparatus according to the present invention, it is possible to protect those parts of the driver unit which particularly need protection, such as the motor and the upper end of the secondary shaft, during interruptions in the gas supply against the liquid surrounding the mixer and the driver unit. The apparatus of the present invention is simple and inexpensive, because—as was already pointed out—the present structure allows for the use of ordinary standard motors and other standard equipment instead of expensive special arrangements.

In the above specification the secondary shaft 13 is partly hollow. This is naturally not an essential feature of the invention, but the gas can be conducted from the channel formed between the two cones to the liquid for instance by aid of a separate gas pipe. During an interruption in the gas supply, the inner cone 12 serves as the protection for the top part of the secondary shaft in a similar fashion as in the description above.

I claim:

1. An immersible apparatus for agitating liquid, comprising a casing having a lower wall, inlet means for supplying gas under pressure to the casing, a mechanical drive unit disposed within the casing and having an output shaft that extends through an aperture in said lower wall, a mixer connected to the output shaft of the drive unit on the opposite side of the lower wall from the drive unit, and a tubular structure secured to the lower wall of the casing and surrounding said aperture and extending to said opposite side of the lower wall, the casing having at least one hole for allowing gas supplied to the casing by way of the inlet means to leave the casing, and the tubular structure and the lower wall together defining a gas trap which, when the apparatus is disposed in liquid with the output shaft extending vertically downwards from the drive unit, prevents liquid from reaching the aperture in said lower wall.

2. Apparatus according to claim 1, wherein the tubular structure is substantially frusto-conical in form having a narrower end and a wider end and is secured to the lower wall by way of its wider end, the narrower end of the tubular structure defining an aperture through which the output shaft extends in space relationship.

3. Apparatus according to claim 1, wherein the inlet means comprise a gas supply pipe that is connected to the casing, the gas supply pipe being bent to form an angle of substantially 90 degrees immediately adjacent the casing.

4. Apparatus according to claim 1, wherein the inlet means are connected to the casing at a location which is closer to the lower wall than are parts of the drive unit that are to be protected from contact with liquid and wherein the casing is imperforate at locations that are farther from the lower wall than the location at which the inlet means are connected to the casing.

5. Apparatus according to claim 1, wherein the hole is formed in the lower wall of the casing.

6. Apparatus according to claim 1, comprising a second tubular structure secured to the lower wall of the casing and surrounding the first-mentioned tubular structure in spaced relationship, the second tubular structure defining an aperture that is spaced from the lower wall and through which the output shaft extends, the output shaft defining a passageway that opens to the exterior of the shaft at a first location that is between the lower wall of the casing and the aperture defined by the second tubular structure and at a second location that is to the opposite side from the first location of the aperture defined by the second tubular structure, and said hole opening into the space between the first-mentioned tubular structure and the second tubular structure, so that gas supplied under pressure to the casing can enter the space defined between the tubular structures by way of the hole in the lower wall and can leave said space by way of the passageway defined by the output shaft.

7. Apparatus according to claim 6, comprising a seal disposed in the aperture defined by the second tubular structure and effective between the output shaft and the second tubular structure.

8. Apparatus according to claim 6, wherein the first-mentioned tubular structure and the second tubular structure are substantially frusto-conical in form and are disposed substantially coaxially with the output shaft.

9. Apparatus according to claim 6, wherein the second tubular structure is substantially frusto-conical in form having a narrower end and a wider end and is secured to the lower wall of the casing by way of its wider end, the narrower end of the second tubular structure being at substantially the same distance from the lower wall as is the end of the drive shaft that is remote from the drive unit.

10. Apparatus according to claim 1, wherein the inlet means are connected to the casing at a location that is closer to the lower wall than are parts of the drive unit that are to be protected from contact with liquid, and there is a path for flow of fluid between the inlet means and the hole that lies entirely between said parts and the lower wall, so that when the apparatus is disposed in liquid with the output shaft extending vertically downwards from the drive unit and supply of gas to the inlet means is interrupted, liquid enters the casing by way of said hole and displaces gas from the casing by way of the inlet means until the level of liquid in the casing reaches the top of the inlet means, whereupon gas trapped in the casing prevents liquid from rising to the level of the parts of the drive unit that are to be protected.

11. Apparatus according to claim 10, comprising wall means disposed inside the casing and defining a gas supply channel that communicates with the inlet means and extends essentially parallel to the output shaft and is open at each end.

12. Apparatus according to claim 11, wherein the casing has a side wall and the wall means have a wide side that extends substantially parallel to the side wall of the casing and two narrower sides by which the wall means are attached to the side wall of the casing.

13. Apparatus according to claim 12, wherein the side wall of the casing is substantially cylindrical and coaxial with the output shaft, and the gas supply channel, in a cross-section perpendicular to the central axis of the side wall of the casing, has substantially the shape of a sector of an annulus.

14. An immersible apparatus for agitating liquid, comprising a casing having a lower wall, inlet means for supplying gas under pressure to the casing, and a mechanical drive unit disposed within the casing, the casing being formed with at least one hole for allowing gas supplied to the casing by way of the inlet means to leave the casing, the inlet means being connected to the casing at a location that is closer to the lower wall than are parts of the drive unit that are to be protected from contact with liquid, and there being a path for flow of fluid between the inlet means and the hole that lies entirely between said parts and the lower wall, so that when the apparatus is disposed in liquid with the lower wall downwards and supply of gas to the inlet means is interrupted, liquid enters the casing by way of said hole and displaces gas from the casing by way of the inlet means until the level of liquid in the casing reaches the top of the inlet means, whereupon gas trapped in the casing prevents liquid from rising to the level of the parts of the drive unit that are to be protected.

15. Apparatus according to claim 14, comprising wall means disposed inside the casing and defining a gas supply channel that communicates with the inlet means and extends essentially parallel to the output shaft and is open at each end.

16. Apparatus according to claim 15, wherein the casing has a side wall and the wall means have a wide side that extends substantially parallel to the side wall of the casing and two narrower sides by which the wall means are attached to the side wall of the casing.

17. Apparatus according to claim 16, wherein the side wall of the casing is substantially cylindrical and coaxial with the output shaft, and the gas supply channel, in a cross-section perpendicular to the central side axis of the wall of the casing, has substantially the shape of a sector of an annulus.

18. Apparatus according to claim 14, wherein the inlet means comprise a gas supply pipe that is connected to the casing, the gas supply pipe being bent to form an angle of substantially 90 degrees immediately adjacent the casing.

19. Apparatus according to claim 18, wherein the hole is formed in the lower wall of the casing.

* * * * *